US012678020B1

(12) United States Patent
Hall, Jr.

(10) Patent No.: US 12,678,020 B1
(45) Date of Patent: Jul. 14, 2026

(54) SHOE CLEANING DEVICE

(71) Applicant: Leonard Hall, Jr., Millersville, MD (US)

(72) Inventor: Leonard Hall, Jr., Millersville, MD (US)

( * ) Notice: Subject to any disclaimer, the term of this patent is extended or adjusted under 35 U.S.C. 154(b) by 391 days.

(21) Appl. No.: 18/508,377

(22) Filed: Nov. 14, 2023

(51) Int. Cl.
*A47L 23/02* (2006.01)
*A47L 23/20* (2006.01)
*A47L 23/22* (2006.01)

(52) U.S. Cl.
CPC ..... *A47L 23/02* (2013.01); *A47L 23/20* (2013.01); *A47L 23/22* (2013.01)

(58) Field of Classification Search
CPC ..... A47L 23/02; A47L 23/20; A47L 23/22
See application file for complete search history.

(56) References Cited

U.S. PATENT DOCUMENTS

| | | | | |
|---|---|---|---|---|
| 2,953,805 | A * | 9/1960 | Sevenich | A47L 23/263 392/382 |
| D338,751 | S | 8/1993 | Huff | |
| 8,533,888 | B2 | 9/2013 | Kessler | |
| 8,533,901 | B2 | 9/2013 | Williams | |
| 9,717,307 | B1 | 8/2017 | Bulger | |
| 10,426,316 | B2 | 10/2019 | Gold | |
| 10,786,138 | B2 | 9/2020 | Anderson | |
| 11,607,105 | B2 | 3/2023 | Rotteveel | |
| 11,752,526 | B1 * | 9/2023 | Strickland | B08B 3/02 15/36 |
| 2012/0066847 | A1 | 3/2012 | Bai | |
| 2020/0275821 | A1 * | 9/2020 | Busken-Jovanovich | B08B 3/02 |
| 2022/0248937 | A1 * | 8/2022 | Gonzalez | A47L 23/02 |
| 2023/0218138 | A1 * | 7/2023 | Lam | A47L 23/26 36/88 |
| 2024/0180391 | A1 * | 6/2024 | Esandi Mateo | A61L 2/0047 |
| 2025/0000328 | A1 * | 1/2025 | George | A61L 2/18 |

FOREIGN PATENT DOCUMENTS

| | | |
|---|---|---|
| WO | 2019209917 | 10/2019 |

* cited by examiner

*Primary Examiner* — Andrew J Marien
(74) *Attorney, Agent, or Firm* — Kyle A. Fletcher, Esq.

(57) ABSTRACT

The shoe cleaning device may include an enclosure, a cleaning solution dispenser, and an air dryer system. The shoe cleaning device may be placed adjacent to an entrance of a building and may be adapted to clean shoes to prevent tracking debris into the building. A pair of shoe cavities on the enclosure may be adapted for a user to step into such that the cleaning solution dispenser may dispense a cleaning solution on outsoles of the shoes and the shoes may be brushed. The air dryer system may blow air onto the shoes to dry the shoes. The cleaning solution dispenser may be activated by downward pressure applied by the shoes and the air dryer system may be adapted to be activated by tapping a pressure sensor with a toe.

20 Claims, 4 Drawing Sheets

SHOE CLEANING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of automatic cleaning systems, more specifically, a shoe cleaning device.

SUMMARY OF INVENTION

The shoe cleaning device may comprise an enclosure, a cleaning solution dispenser, and an air dryer system. The shoe cleaning device may be placed adjacent to an entrance of a building and may be adapted to clean shoes to prevent tracking debris into the building. A pair of shoe cavities on the enclosure may be adapted for a user to step into such that the cleaning solution dispenser may dispense a cleaning solution on outsoles of the shoes and the shoes may be brushed. The air dryer system may blow air onto the shoes to dry the shoes. The cleaning solution dispenser may be activated by downward pressure applied by the shoes and the air dryer system may be adapted to be activated by tapping a pressure sensor with a toe. An object of the invention is to clean a pair of shoes positioned within a pair of shoe cavities.

Another object of the invention is to provide a cleaning solution dispenser to dispense a cleaning solution onto the outsoles of the shoes via a left plurality of nozzles located within the left shoe cavity and a right plurality of nozzles located within the right shoe cavity.

A further object of the invention is to provide an air dryer system to blow air across the shoes in order to dry the shoes.

Yet another object of the invention is to provide a left brush and a right brush to brush debris from the shoes.

These together with additional objects, features and advantages of the shoe cleaning device will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe cleaning device in detail, it is to be understood that the shoe cleaning device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe cleaning device.

It is therefore important that the claims be regarded as including such equivalent construction insofar as they do not depart from the spirit and scope of the shoe cleaning device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
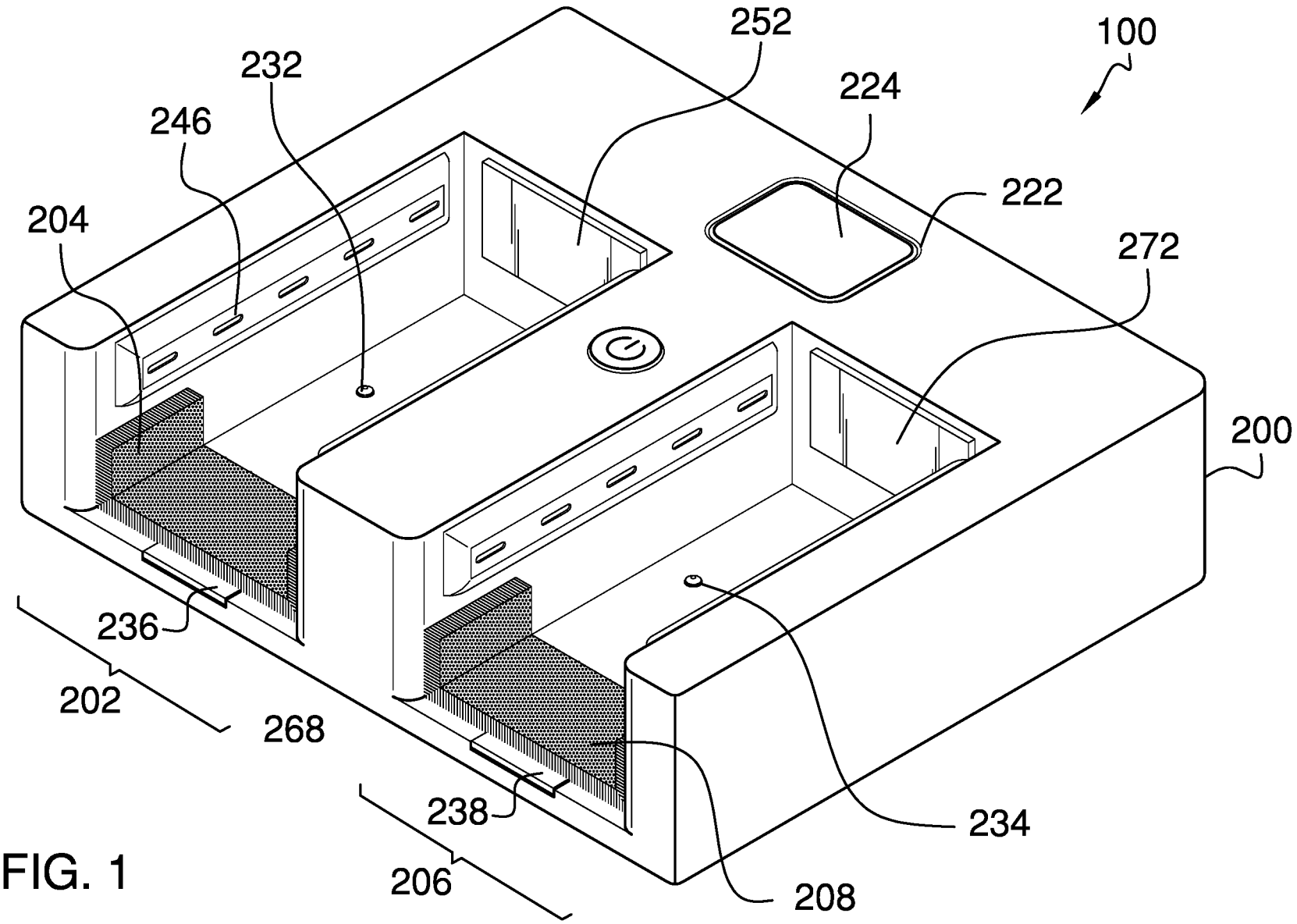
FIG. 1 is an isometric view of an embodiment of the disclosure.
Figure 2:
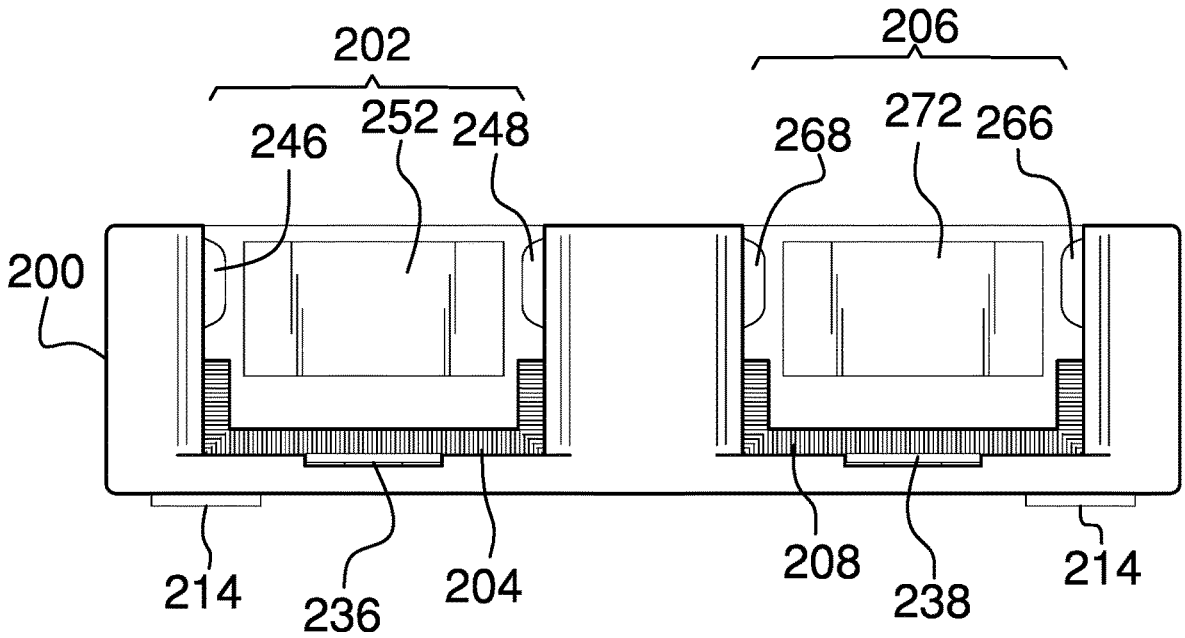
FIG. 2 is a front view of an embodiment of the disclosure.
Figure 3:
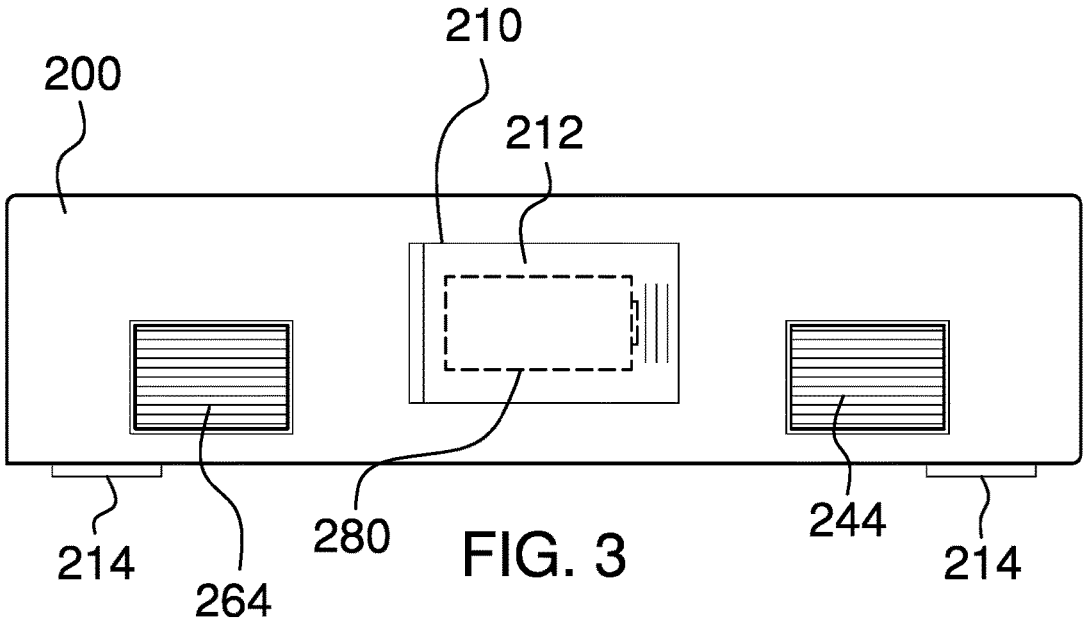
FIG. 3 is a rear view of an embodiment of the disclosure.
Figure 4:
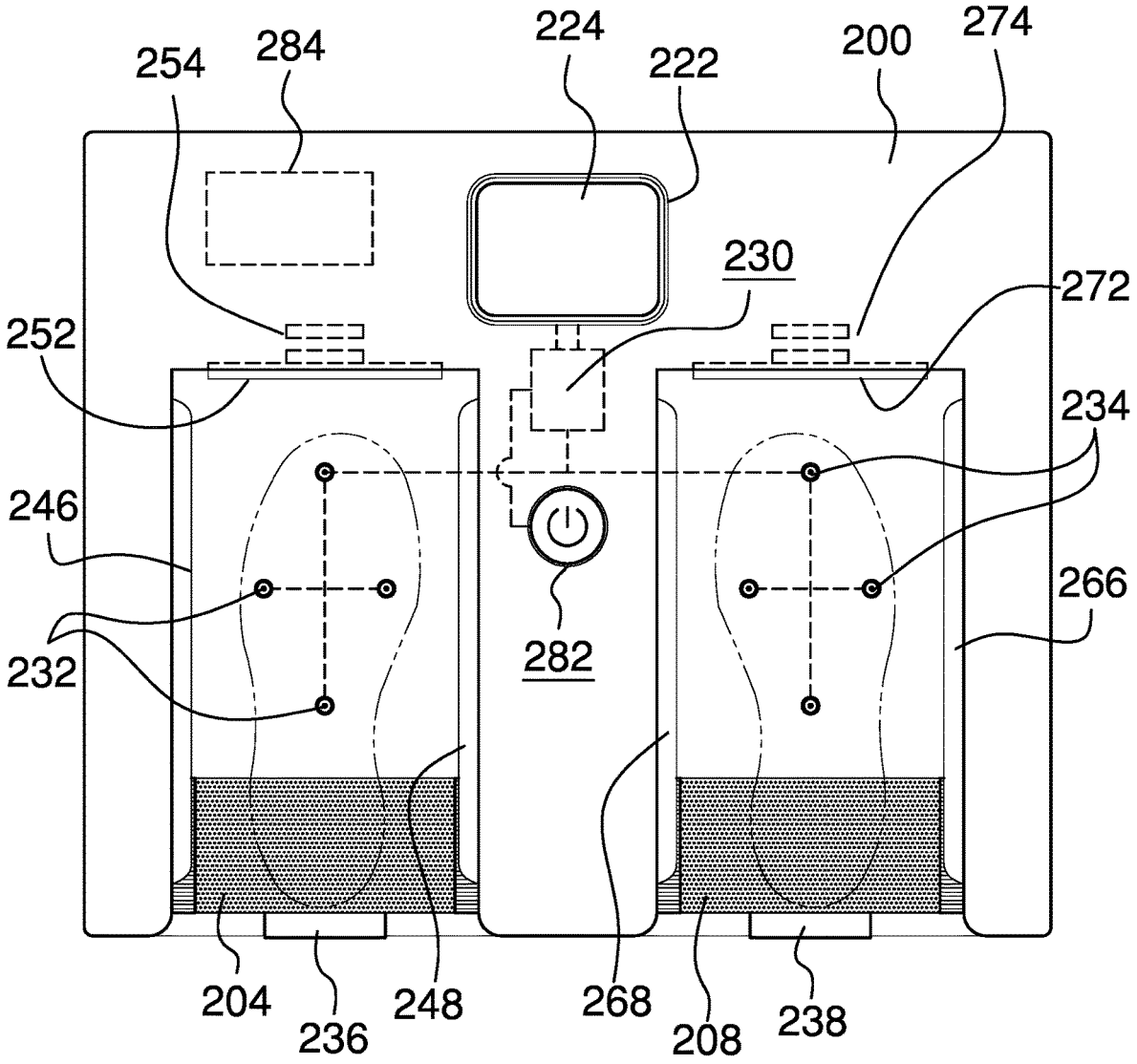
FIG. 4 is a top view of an embodiment of the disclosure.
Figure 5:
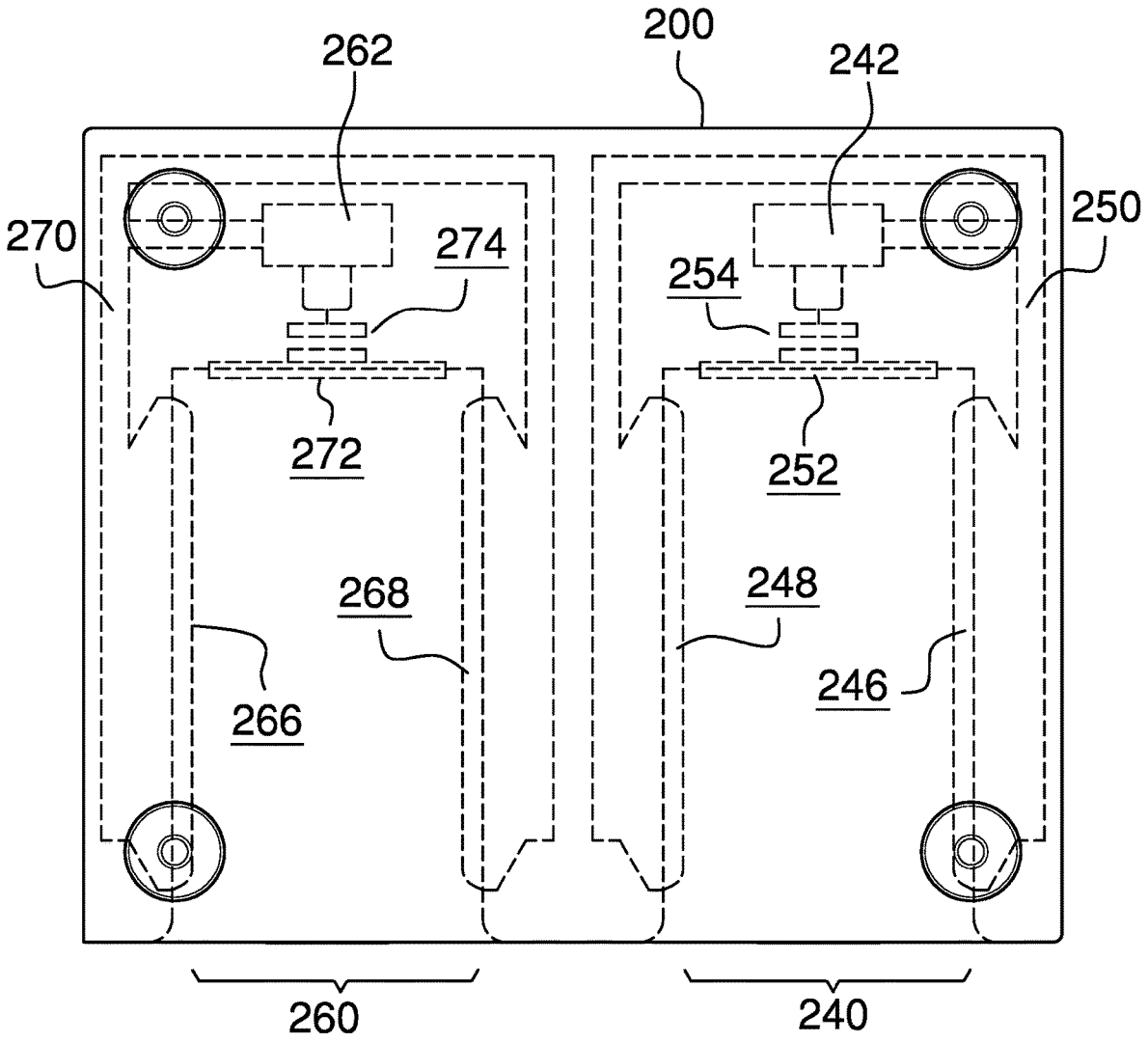
FIG. 5 is a bottom view of an embodiment of the disclosure.

Detailed reference will now be made to a first potential embodiment of the disclosure, which is illustrated in FIGS. 1 through 5.

The shoe cleaning device 100 (hereinafter invention) comprises an enclosure 200, a cleaning solution dispenser, and an air dryer system. The invention 100 may be placed adjacent to an entrance of a building and may be adapted to clean shoes to prevent tracking debris into the building. A pair of shoe cavities on the enclosure 200 may be adapted for a user to step into such that the cleaning solution dispenser may dispense a cleaning solution on outsoles of the shoes and the shoes may be brushed. The air dryer system may blow air onto the shoes to dry the shoes. The cleaning solution dispenser may be activated by downward pressure and the air dryer system may be adapted to be activated by tapping a pressure sensor with a toe.

The pair of shoe cavities on the enclosure 200 may comprise a left shoe cavity 202 for receiving a user's left shoe and a right shoe cavity 206 for receiving a user's right shoe. An individual shoe cavity selected from the left shoe cavity 202 and the right shoe cavity 206 may comprise a rectangular slot on the top of the enclosure 200 that opens to the proximal side of the enclosure 200 and is closed on the distal side of the enclosure 200 such that an individual shoe may be pushed into the individual shoe cavity horizontally from the distal side of the enclosure 200.

The left shoe cavity 202 may comprise a left brush 204 located at the distal end of the left shoe cavity 202. The left brush 204 may be adapted to brush the bottom and sides of the user's left shoe as the user's left shoe is moved over the left brush 204. The right shoe cavity 206 may comprise a right brush 208 located at the distal end of the right shoe cavity 206. The right brush 208 may be adapted to brush the bottom and sides of the user's right shoe as the user's right shoe is moved over the right brush 208.

The enclosure 200 may comprise a battery compartment 210 that houses one or more batteries 280 that power the cleaning solution dispenser and the air dryer system when an ON/OFF control 282 is on the ON position. The one or more batteries 280 may be accessible by removing a battery access door 212 that may cover the battery compartment 210. The bottom of the enclosure 200 may comprise a plurality of foot pads 214 to prevent marring the surface that the invention 100 rests upon.

The cleaning solution dispenser may dispense the cleaning solution onto the outsoles of the shoes. The shoes may be positioned in the pair of shoe cavities while being worn and the cleaning solution dispenser may be activated by applying downward pressure to a left pressure sensor 236, a right pressure sensor 238, or both. The cleaning solution dispenser may comprise a pump 230 that may pump the cleaning solution from a cleaning solution reservoir 222 to a left plurality of nozzles 232 and to a right plurality of nozzles 234 via internal tubing. The left plurality of nozzles 232 may be located on the bottom of the left shoe cavity 202 and may be oriented to dispense the cleaning solution upward onto the user's left shoe. The right plurality of nozzles 234 may be located on the bottom of the right shoe cavity 206 and may be oriented to dispense the cleaning solution upward onto the user's right shoe.

In some embodiments, each of the left plurality of nozzles 232 and the right plurality of nozzles 234 may comprise one or more apertures to introduce air into the cleaning solution as the cleaning solution is dispensed such that an antiseptic foam cleaner may be placed into the cleaning solution reservoir 222 as a liquid and may be applied to the outsoles as a foam.

The cleaning solution reservoir 222 may be a container configured to hold a supply of the cleaning solution. The cleaning solution reservoir 222 may comprise a cap 224 that may be accessible on the exterior of the enclosure 200. The cap 224 may be opened to refill the cleaning solution reservoir 222.

The pump 230 may move the cleaning solution from the cleaning solution reservoir 222 to the left plurality of nozzles 232 and the right plurality of nozzles 234. The pump 230 may be electromechanical and may comprise an internal motor that may be energized by the application of an electrical potential to the pump 230. As non-limiting examples, the pump 230 may move the cleaning solution by applying rotary motion, reciprocating motion, linear motion, or a combination thereof to one or more gears, screws, pistons, shuttle blocks, vanes, diaphragms, plungers, chains, ropes, impellers, or combinations thereof.

In some embodiments, the left pressure sensor 236 may be located beneath the left brush 204 and the right pressure sensor 238 may be located beneath the right brush 208.

The air dryer system may comprise a left air dryer 240 and a right air dryer 260. The left air dryer 240 may be configured to blow air over the user's left shoe in order to dry the user's left shoe. The right air dryer 260 may be configured to blow air over the user's right shoe in order to dry the user's right shoe. The left air dryer 240 and the right air dryer 260 may operate independently.

The left air dryer 240 may comprise a left air blower 242 that may blow air over the user's left shoe when the left air blower 242 is activated. The left air blower 242 may draw air in through a left air intake vent 244 and may pump the air to a left outside shoe vent 246 and to a left inside shoe vent 248 via left air ductwork 250. The left air intake vent 244 may be accessible on the exterior of the enclosure 200.

The left outside shoe vent 246 may be positioned on the side of the left shoe cavity 202 adjacent to the outside of the user's left shoe. Stated differently, the left outside shoe vent 246 may be positioned on the side of the left shoe cavity 202 that is opposite the big toe. The left inside shoe vent 248 may be positioned on the side of the left shoe cavity 202 adjacent to the inside of the user's left shoe. The left inside shoe vent 248 may therefore be located opposite the left outside shoe vent 246.

The left air blower 242 may be activated by tapping a left kick plate 252 located at the distal end of the left shoe cavity 202. The left kick plate 252 may contact a left blower control 254 to complete an electrical circuit that energizes the left air blower 242.

The right air dryer 260 may comprise a right air blower 262 that may blow air over the user's right shoe when the right air blower 262 is activated. The right air blower 262 may draw air in through a right air intake vent 264 and may pump the air to a right outside shoe vent 266 and to a right inside shoe vent 268 via right air ductwork 270. The right air intake vent 264 may be accessible on the exterior of the enclosure 200.

The right outside shoe vent 266 may be positioned on the side of the right shoe cavity 206 adjacent to the outside of the user's right shoe. Stated differently, the right outside shoe vent 266 may be positioned on the side of the right shoe cavity 206 that is opposite the big toe. The right inside shoe vent 268 may be positioned on the side of the right shoe cavity 206 adjacent to the inside of the user's right shoe. The right inside shoe vent 268 may therefore be located opposite the right outside shoe vent 266.

The right air blower 262 may be activated by tapping a right kick plate 272 located at the distal end of the right shoe 23 cavity 206. The right kick plate 272 may contact a right blower 24 control 274 to complete an electrical circuit that energizes the right air blower 262.

As non-limiting examples, the left air blower 242 and the right air blower 262 may be air moving devices that may move air using a rotating impeller, spinning fan blades, or any combination thereof.

As a non-limiting example, an individual blower control selected from the left blower control 254 and the right blower control 274 may be a momentary contact switch.

In some embodiments, a control circuit 284 may control the sequencing and timing of operation of the invention 100. As a non-limiting example, the control circuit 284 may receive electrical signals from the left blower control 254 and/or the right blower control 274, may energize the left air blower 242 and/or the right air blower 262, and may de-energize the left air blower 242 and/or the right air blower 262 after a timed interval.

In use, the user may step onto the invention 100 such that the user's left shoe is positioned in the left shoe cavity 202 and the user's right shoe is position in the right shoe cavity 206. The user may press down on the left pressure sensor 236, the right pressure sensor 238, or both to activate the pump 230. Activating the pump 230 may force the cleaning solution to be dispensed via the left plurality of nozzles 232 and the right plurality of nozzles 234 onto the outsoles of the shoes. The user may move the shoes back and forth over the left brush 204 and the right brush 208 to remove the debris. The user may tap the left kick plate 252 to activate the left air blower 242 such that air is blown from the left outside shoe vent 246 and the left inside shoe vent 248 to dry the user's left shoe. The user may tap the right kick plate 272 to activate the right air blower 262 such that air is blown from the right outside shoe vent 266 and the right inside shoe vent 268 to dry the user's right shoe.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "cavity" may be an empty space or negative space that is formed within an object.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw. In some embodiments, a control may alter an electrical property of a circuit such as resistance, inductance, or capacitance.

As used herein, "energize" and/or "energization" may refer to the application of an electrical potential to a system or subsystem. "De-energize" and/or "de-energization" may refer to the removal of the electrical potential.

As used in this disclosure, the word "exterior" may be used as a relational term that implies that an object is not located or contained within the boundary of a structure or a space.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the "outsole" may be the outer component of the sole of the shoe that is in contact with the 2 ground.

As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used herein, "reservoir" may refer to a container or containment system that is configured to store a liquid, gas, or gel.

As used in this disclosure, a "sensor" may be a device that quantitatively measures a physical stimulus.

As used in this disclosure, a "slot" may be a prism-shaped negative space formed as a groove, cut, opening, or aperture in or through an object.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used herein, "vent" may refer to one or more openings in the structure that allow air to enter or escape.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A shoe cleaning device comprising:

an enclosure, a cleaning solution dispenser, and an air dryer system;

wherein the shoe cleaning device is placed adjacent to an entrance of a building and is adapted to clean shoes to prevent tracking debris into the building;

wherein a pair of shoe cavities on the enclosure is adapted for a user to step into such that the cleaning solution dispenser dispenses a cleaning solution on outsoles of the shoes;

wherein the air dryer system blows air onto the shoes to dry the shoes;

wherein the cleaning solution dispenser is activated by downward pressure and the air dryer system is adapted to be activated by tapping a pressure sensor with a toe.

2. The shoe cleaning device according to claim 1 wherein the pair of shoe cavities on the enclosure comprises a left shoe cavity for receiving a user's left shoe and a right shoe cavity for receiving a user's right shoe;

wherein an individual shoe cavity selected from the left shoe cavity and the right shoe cavity comprises a rectangular slot on a top of the enclosure that opens to a proximal side of the enclosure and is closed on a distal side of the enclosure such that an individual shoe is pushed into the individual shoe cavity horizontally from the proximal side of the enclosure.

3. The shoe cleaning device according to claim 2 wherein the left shoe cavity comprises a left brush located at a distal end of the left shoe cavity;

wherein the left brush is adapted to brush a bottom and sides of the user's left shoe as the user's left shoe is moved over the left brush;

wherein the right shoe cavity comprises a right brush located at a distal end of the right shoe cavity;

wherein the right brush is adapted to brush a bottom and sides of the user's right shoe as the user's right shoe is moved over the right brush.

4. The shoe cleaning device according to claim 3 wherein the enclosure comprises a battery compartment that houses one or more batteries that power the cleaning solution dispenser and the air dryer system when an ON/OFF control is on an ON position;

wherein the one or more batteries are accessible by removing a battery access door that covers the battery compartment.

5. The shoe cleaning device according to claim 4 wherein the cleaning solution dispenser dispenses the cleaning solution onto outsoles of the shoes;

wherein the shoes are positioned in the pair of shoe cavities while being worn and the cleaning solution dispenser is activated by applying downward pressure to a left pressure sensor, a right pressure sensor, or both;

wherein the cleaning solution dispenser comprises a pump that pumps the cleaning solution from a cleaning solution reservoir to a left plurality of nozzles and to a right plurality of nozzles via internal tubing;

wherein the left plurality of nozzles are located on a bottom of the left shoe cavity and are oriented to dispense the cleaning solution upward onto the user's left shoe;

wherein the right plurality of nozzles are located on a bottom of the right shoe cavity and are oriented to dispense the cleaning solution upward onto the user's right shoe.

6. The shoe cleaning device according to claim 5 wherein each of the left plurality of nozzles and the right plurality of nozzles comprise one or more apertures to introduce air into the cleaning solution as the cleaning solution is dispensed such that an antiseptic foam cleaner is placed into the cleaning solution reservoir as a liquid and is applied to the outsoles as a foam.

7. The shoe cleaning device according to claim 6 wherein the cleaning solution reservoir is a container configured to hold a supply of the cleaning solution;

wherein the cleaning solution reservoir comprises a cap that is accessible on an exterior of the enclosure;

wherein the cap is opened to refill the cleaning solution reservoir.

8. The shoe cleaning device according to claim 7 wherein the pump moves the cleaning solution from the cleaning solution reservoir to the left plurality of nozzles and the right plurality of nozzles;

wherein the pump is electromechanical and comprises an internal motor that is energized by an application of an electrical potential to the pump.

9. The shoe cleaning device according to claim 8 wherein the left pressure sensor is located beneath the left brush and the right pressure sensor is located beneath the right brush.

10. The shoe cleaning device according to claim 9 wherein the air dryer system comprises a left air dryer and a right air dryer;

wherein the left air dryer is configured to blow air over the user's left shoe in order to dry the user's left shoe;

wherein the right air dryer is configured to blow air over the user's right shoe in order to dry the user's right shoe;

wherein the left air dryer and the right air dryer operate independently.

11. The shoe cleaning device according to claim 10 wherein the left air dryer comprises a left air blower that blows air over the user's left shoe when the left air blower is activated;

wherein the left air blower draws air in through a left air intake vent and pumps the air to a left outside shoe vent and to a left inside shoe vent via left air ductwork;

wherein the left air intake vent is accessible on the exterior of the enclosure.

12. The shoe cleaning device according to claim 11 wherein the left outside shoe vent is positioned on the side of the left shoe cavity adjacent to an outside of the user's left shoe;

wherein the left inside shoe vent is positioned on a side of the left shoe cavity adjacent to an inside of the user's left shoe.

13. The shoe cleaning device according to claim 12 wherein the left air blower is activated by tapping a left kick;

wherein the left kick plate contacts a left blower control to complete an electrical circuit that energizes the left air blower.

14. The shoe cleaning device according to claim 13 wherein the right air dryer comprises a right air blower that blows air over the user's right shoe when the right air blower is activated;

wherein the right air blower draws air in through a right air intake vent and pumps the air to a right outside shoe vent and to a right inside shoe vent via right air ductwork;

wherein the right air intake vent is accessible on an exterior of the enclosure.

15. The shoe cleaning device according to claim 14 wherein the right outside shoe vent is positioned on a side of the right shoe cavity adjacent to the outside of the user's right shoe;

wherein the right inside shoe vent is positioned on a side of the right shoe cavity adjacent to an inside of the user's right shoe.

16. The shoe cleaning device according to claim 15 wherein the right air blower is activated by tapping a right kick plate;

wherein the right kick plate contacts a right blower control to complete an electrical circuit that energizes the right air blower.

17. The shoe cleaning device according to claim 16 wherein the left air blower and the right air blower are air moving devices that move air using a rotating impeller, spinning fan blades, or any combination thereof.

18. The shoe cleaning device according to claim 16 wherein an individual blower control selected from the left blower control and the right blower control is a momentary contact switch.

19. The shoe cleaning device according to claim 16 wherein a control circuit controls a sequencing and timing of operation of the shoe cleaning device.

20. The shoe cleaning device according to claim 19 wherein the control circuit receives electrical signals from the left blower control and/or the right blower control, energizes the left air blower and/or the right air blower, and de-energizes the left air blower and/or the right air blower after a timed interval.

* * * * *